US009099095B2

(12) United States Patent
Lee

(10) Patent No.: US 9,099,095 B2
(45) Date of Patent: Aug. 4, 2015

(54) APPARATUS AND METHOD OF PROCESSING A RECEIVED VOICE SIGNAL IN A MOBILE TERMINAL

(75) Inventor: Nam-Il Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1133 days.

(21) Appl. No.: 12/685,741

(22) Filed: Jan. 12, 2010

(65) Prior Publication Data

US 2010/0179809 A1 Jul. 15, 2010

(30) Foreign Application Priority Data

Jan. 12, 2009 (KR) ..... 10-2009-0002283

(51) Int. Cl.
*G10L 21/02* (2013.01)
*G10L 21/0208* (2013.01)
*G10L 25/00* (2013.01)

(52) U.S. Cl.
CPC ..... *G10L 21/0208* (2013.01); *G10L 25/00* (2013.01)

(58) Field of Classification Search
USPC ..... 704/200, 206, 207, 210, 215, 225, 201, 704/208, 214, 226–228; 455/3.06; 379/88.07, 402, 406.01, 387.01
See application file for complete search history.

(56) References Cited

U.S. PATENT DOCUMENTS

| | | | | |
|---|---|---|---|---|
| 4,829,565 | A | 5/1989 | Goldberg | |
| 5,615,256 | A | 3/1997 | Yamashita | |
| 6,094,481 | A | 7/2000 | Deville et al. | |
| 6,163,608 | A * | 12/2000 | Romesburg et al. | 379/406.01 |
| 6,768,979 | B1 * | 7/2004 | Menendez-Pidal et al. | 704/226 |
| 7,089,181 | B2 * | 8/2006 | Erell | 704/225 |
| 7,092,875 | B2 * | 8/2006 | Tsuchinaga et al. | 704/210 |
| 7,139,393 | B1 * | 11/2006 | Murase | 379/402 |
| 7,164,755 | B1 * | 1/2007 | Yokoyama | 379/88.07 |
| 7,933,548 | B2 * | 4/2011 | Mori | 455/3.06 |
| 2003/0002659 | A1 * | 1/2003 | Erell | 379/387.01 |
| 2006/0247920 | A1 * | 11/2006 | Toriyama | 704/201 |

FOREIGN PATENT DOCUMENTS

| | | |
|---|---|---|
| JP | 2003-60459 | 2/2003 |
| KR | 10-2008-0011865 | 2/2008 |

OTHER PUBLICATIONS

Korean Notification of the Reasons for Rejection issued Mar. 12, 2015 in corresponding Korean Patent Application 10-2009-0002283.

* cited by examiner

*Primary Examiner* — Huyen Vo
(74) *Attorney, Agent, or Firm* — Staas & Halsey LLP

(57) ABSTRACT

An apparatus and a method thereof, processes a voice signal of a mobile terminal in a mobile communication system. The apparatus to process a received-voice signal received through a wireless channel in a mobile terminal includes a digital signal processing unit to generate an encoded packet and frame type information defining a characteristic of the encoded packet by performing voice encoding on an audible signal input from a microphone. The apparatus also includes a received-voice controlling unit to determine a noise level in consideration of the frame type information and a level of the audible signal, and to control at least one of a tone and a volume of a received voice by the determined noise level.

14 Claims, 5 Drawing Sheets

APPARATUS AND METHOD OF PROCESSING A RECEIVED VOICE SIGNAL IN A MOBILE TERMINAL

CROSS-REFERENCE TO RELATED APPLICATIONS

This application claims priority under 35 U.S.C. §119(a) from Korean Patent Application No. 10-2009-0002283, filed on Jan. 12, 2009, in the Korean Intellectual Property Office, the disclosure of which is incorporated herein by reference.

BACKGROUND

1. Field of the Invention

The present general inventive concept relates to an apparatus and a method of processing a voice signal of a mobile terminal in a mobile communication system, and more particularly, to an apparatus and a method of processing a received-voice signal of a mobile terminal in a mobile communication system.

2. Description of the Related Art

Generally, a mobile terminal is a device with which a user can transmit and receive voice and data in a mobile environment anywhere at any time. There are various kinds of mobile terminals, such as a cellular phone, a WAP (Work Analysis Program) phone, a PDA (Personal Digital Assistants), and a Web Pad, and such mobile terminals are used by many people for personal service and extension of mobility.

In a voice call using a mobile terminal, the call is generally performed under a condition where ambient noise exists. An influence of the noise may be considered from a standpoint of transmission and reception.

First, from the standpoint of transmission, in a case in which a signal is input into a microphone, ambient noise as well as a voice of a transmitter is input. Accordingly, when this ambient noise and voice is encoded as is and transmitted, it is difficult for a receiver to recognize a received voice due to a low SNR (Signal-to-Noise Ratio). Taking this characteristic into account, noise removal on a signal input by a microphone is performed by using hardware (H/W) or software (S/W) in voice transmission. The above described method of removing the ambient noise of the transmitter is generally widely used at present.

Meanwhile, from the standpoint of reception, when noise is present and strongly occurs around the receiver, the received voice cannot be clearly recognized. Moreover, the transmitter cannot recognize the state of the noise occurring around the receiver, and thus a countermeasure against the noise occurring around the receiver has to be considered based on the receiver-side of a transmitted input signal.

Hereinafter, methods of eliminating the influence of the noise occurring around the receiver, on the receiver-side of the transmitted input signal, will be described.

In a first method, during the occurrence of noise, a volume key is used to increase a reception volume. In this method, whenever a level or state of the noise is changed, it is required to vary volume settings. Taking this characteristic into account, the method employs an automatic change of a volume according to a noise level. However, in this case, since both noise and voice are included in microphone input, it is necessary to additionally mount a noise measuring microphone at a position as far as possible from a call microphone in which noise is input in order to separate the voice from the noise.

In a second method of reducing the influence of the noise occurring around the receiver, it is determined if an input signal includes voice, and a calculated gain is applied only when the input signal includes noise. However, in this case, the determination of whether each input includes voice, increases computational complexity, and also, the computational complexity increases in proportion to an overall precision of this method.

In a third method, gain values are stored in a gain table. During a voice duration, a previous gain value is maintained. In a noise duration, a changed gain value is applied. However, the voice duration is required to be calculated each time an input signal includes voice, thus, the computational complexity increases.

As described above, the prior art has performed operations for compensating received voice based on calculations of the level of ambient noise at the receiver-side of a transmitted input signal. However, an operation of determining when the input signal is voice or noise through an analysis of the characteristic of the input signal is required each time, and thus, power consumption and time delay occur.

SUMMARY OF THE INVENTION

The present general inventive concept is provided to solve the above-mentioned problems occurring in the prior art, and provides an apparatus and a method of compensating received voice by determining if an input signal includes voice without performance of an additional operation.

The present general inventive concept also provides an apparatus and a method of reducing power consumption and time delay by determining if an input signal includes voice without the performance of an additional operation.

The present general inventive concept also provides an apparatus and a method of reducing computational complexity and time delay by using previously generated frame type information.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by an apparatus to process a received-voice signal received through a wireless channel in a mobile terminal, the apparatus including a digital signal processing unit to generate an encoded packet and frame type information defining a characteristic of the encoded packet by performing voice encoding on an audible signal input from a microphone, and a received-voice controlling unit to determine a noise level in consideration of the frame type information and a level of the audible signal, and to control at least one of a tone and a volume of received voice based on the determined noise level.

The received-voice controlling unit may include a noise level determining unit to determine the noise level in consideration of the frame type information and the level of the audible signal, and a controlling unit to control the at least one of the tone and the volume of the received voice based on the determined noise level.

The noise level determining unit may maintain a previously used noise level when the encoded packet is determined as a voice frame by the frame type information, and determines the noise level by the level of the audible signal when the encoded packet is determined as a silent frame by the frame type information.

The controlling unit may include a tone controlling unit to control the tone of the received voice based on the determined noise level, and a volume controlling unit to control the volume of the received voice or the tone-controlled received voice based on the determined noise level.

The foregoing and/or other aspects and utilities of the general inventive concept may also be achieved by a method of processing a received-voice signal received through a wireless channel in a mobile terminal, the method including generating an encoded packet and frame type information defining a characteristic of the encoded packet by performing voice encoding on an audible signal input from a microphone, determining a noise level in consideration of the frame type information and a level of the audible signal, and controlling at least one of a tone and a volume of received voice based on the determined noise level.

The determining the noise level in consideration of the frame type information and the level of the audible signal may maintain a previously used noise level when the encoded packet is determined as a voice frame by the frame type information, and determine the noise level by the level of the audible signal when the encoded packet is determined as a silent frame by the frame type information.

The controlling the at least one of the tone and the volume of the received voice by the determined noise level may include at least one of controlling the tone of the received voice based on the determined noise level, and controlling the volume of the received voice or the tone-controlled received voice based on the determined noise level.

The foregoing and/or other aspects and utilities of the general inventive concept may also be achieved by a mobile terminal to process a received-voice signal, including a receiving unit to receive a signal input to the mobile terminal, a processor to determine if the input signal is a voice signal or a noise signal, a controlling unit to control the received-voice signal by using a noise level of a previously input signal if the input signal is determined to be the voice signal and by using a noise level of a current input signal if the input signal is determined to be the noise signal.

The foregoing and/or other aspects and utilities of the general inventive concept may also be achieved by a wireless communication apparatus to process a received-voice signal, including a first mobile terminal to receive a signal input from a second mobile terminal, the first mobile terminal including a digital signal processor to generate frame type information corresponding to the input signal, a processor to determine if the frame type information includes a voice frame or a silent frame, and a controlling unit to control the received-voice signal by using a noise level of a previously input signal if the frame type information includes the voice frame and using a noise level of a current input signal if the frame type information includes the silent frame.

The controlling unit may control the received-voice signal to output an improved received-voice signal to the second mobile terminal.

The controlling unit may control at least one of a tone and a volume of a received-voice based on the determination of the frame type information.

The foregoing and/or other aspects and utilities of the general inventive concept may also be achieved by a method of processing a received-voice signal via a mobile terminal, including receiving a signal input to the mobile terminal, determining if the input signal is a voice signal or a noise signal, and controlling the received-voice signal by using a noise level of a previously input signal if the input signal is determined to be the voice signal and using a noise level of a current input signal if the input signal is determined to be the noise signal.

The foregoing and/or other aspects and utilities of the general inventive concept may also be achieved by a computer-readable recording medium having embodied thereon a computer program that, when executed by a computer, performs a method of processing a received-voice signal via a mobile terminal, wherein the method includes receiving a signal input to the mobile terminal, determining if the input signal is a voice signal or a noise signal, and controlling the received-voice signal by using a noise level of a previously input signal if the input signal is determined to be the voice signal and using a noise level of a current input signal if the input signal is determined to be the noise signal.

BRIEF DESCRIPTION OF THE DRAWINGS

These and/or other aspects and utilities of the present general inventive concept will become apparent and more readily appreciated from the following detailed description, taken in conjunction with the accompanying drawings of which.

DETAILED DESCRIPTION OF THE EMBODIMENTS

Figure 1:
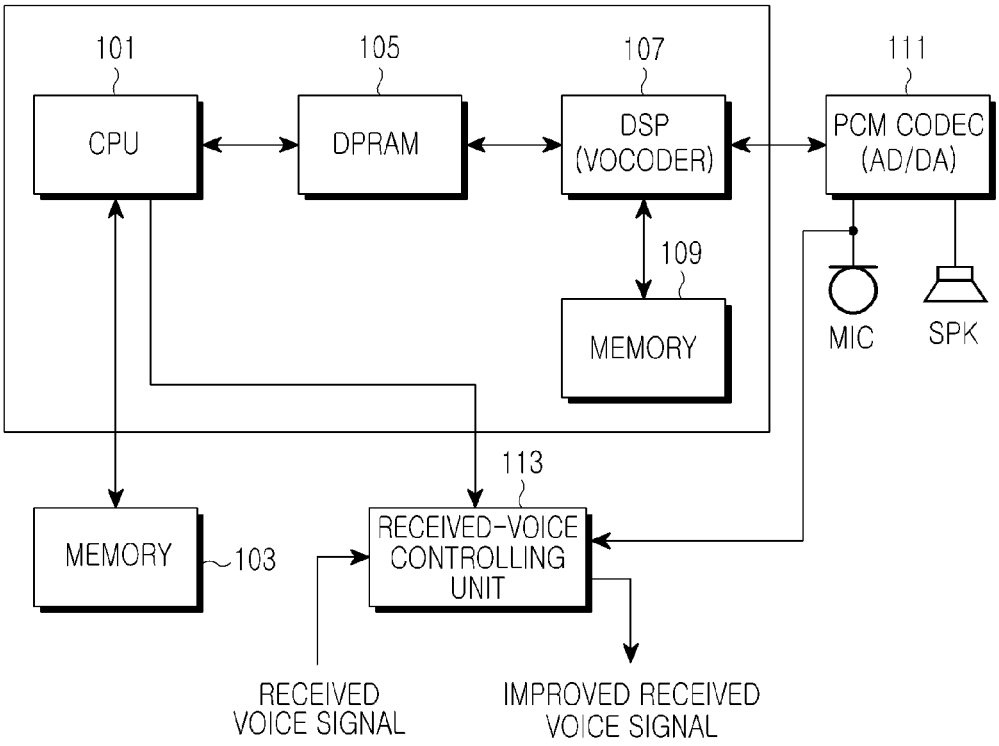
FIG. 1 is a view showing the internal configuration of a mobile terminal according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

According to the present general inventive concept, frame type information generated by voice encoding of a signal input via a microphone is analyzed. If the input signal is determined to include voice based on the analyzed result, a received voice is output based on the determined result.

FIG. 1 is a view showing the internal configuration of a mobile terminal according to an embodiment of the present general inventive concept. As shown in FIG. 1, the mobile terminal according to the present general inventive concept includes a CPU (Central Processing Unit) 101, a DPRAM (Dual-ported Random Access Memory) 105, a DSP (Digital Signal Processor) 107, memory 103, memory 109, a PCM (Pulse Code Modulation) codec 111, and a received-voice controlling unit 113.

Referring to FIG. 1, the PCM codec 111 converts an analog voice signal input from a microphone (MIC) into a digital voice signal during transmission, and converts a digital voice signal into an analog voice signal to output to the analog voice signal through a speaker (SPK) during reception. The DSP 107 performs voice encoding on the digital voice signal provided from the PCM codec 111 during transmission. Also, the DSP 107 performs voice decoding on the received digital voice signal during reception, and provides the voice-decoded digital voice signal to the PCM codec 111. The DSP 107 generates not only a voice packet but also frame characteristic information corresponding to the voice packet through the voice encoding on the digital voice signal.

The CPU 101 performs the control of a tone and/or a volume of a received-voice signal according to the frame characteristic information generated through the voice encoding by the DSP 107.

For example, when it is determined that an encoded packet is a voice frame by the frame characteristic information, a voice flag is set to control a tone and/or a volume of a received-voice signal by using a noise level calculated for a previously encoded packet (silent packet).

When it is determined that the encoded packet is a noise frame (silent frame) by the frame characteristic information, a noise flag is set to control a tone and/or a volume of a received-voice signal by using a noise level calculated for a corresponding noise frame (silent frame).

Although not shown in FIG. 1, when the received-voice signal is received through a wireless channel, the CPU 101 controls the performance of channel decoding on the received-voice signal. Also, when a transmission voice signal is transmitted through the wireless channel, the CPU 101 controls the performance of channel encoding on the transmission voice signal.

The CPU 101 and the DSP 107 are additionally provided with the memory 103 and the memory 109, respectively, and both the CPU 101 and the DSP 107 share a voice-encoded packet and frame characteristic information corresponding to the packet via the DPRAM 105. Therefore, the frame type information generated through the performance of the voice encoding by the DSP 107 is recorded in the DPRAM 105, and then the CPU 101 can access the frame type information via the DPRAM 105.

The received-voice controlling unit 113 receives the voice/noise flag provided from the CPU 101 and the input of the microphone input signal, as well as the received-voice signal output from a microphone of a wireless communication device, and then outputs an improved received-voice signal to the wireless communication device. The received-voice signal is received through a wireless channel, and may be any one of a channel-decoded received-voice signal and a voice-decoded received-voice signal.

However, according to the type of the received-voice signal, a configuration to provide the improved received-voice signal output from the received-voice controlling unit 113 may be varied. In other words, when the received-voice signal is a channel-decoded received-voice signal, the improved received-voice signal output from the received-voice controlling unit 113 may be provided to the DSP 107 so that the improved received-voice signal may be subjected to voice decoding. However, when the received-voice signal is a voice-decoded received-voice signal, the improved received-voice signal output from the received-voice controlling unit 113 may be provided to the PCM codec 111.

In the above description, the received-voice signal is divided into two types, but it will be apparent to one skilled in the art that other combinations are possible.

In order to output an improved received-voice signal, the received-voice controlling unit 113 controls the tone and/or volume of the received-voice signal in consideration of the voice/noise flag provided from the CPU 101.

For example, when the voice flag is provided from the CPU 101, the received-voice controlling unit 113 controls the tone and/or volume of the received-voice signal by using the noise level calculated for the previously encoded packet (silent packet). Otherwise, when the noise flag is provided from the CPU 101, the received-voice controlling unit 113 controls the tone and/or volume of the received-voice signal by using the noise level calculated at a time in which the microphone input signal is input.

Although FIG. 1 shows that the voice signal output through the microphone is provided to the received-voice controlling unit 113, a digital-type voice signal output from the PCM codec 111 or the voice-encoded voice signal output from the DSP 107 may be provided to the received-voice controlling unit 113.

Figure 2:
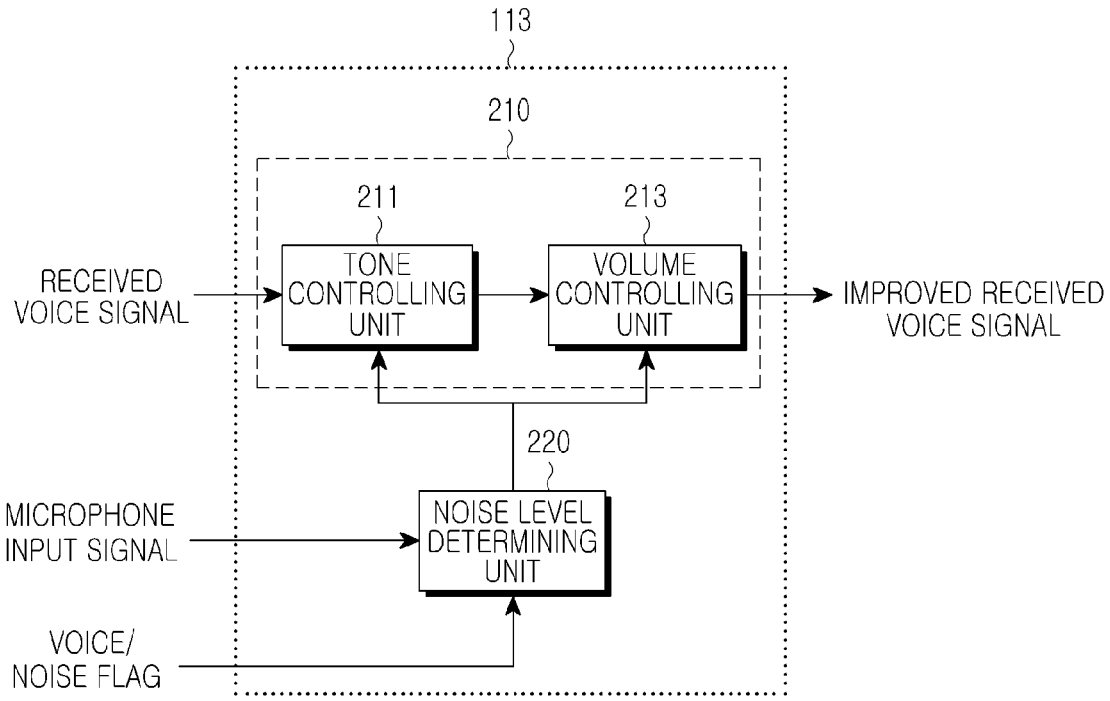
FIG. 2 is a view showing the configuration of a received-voice controlling unit to control a tone and/or a volume of a received-voice signal in a mobile terminal according to an embodiment of the present general inventive concept.

FIG. 2 is a view showing the configuration of a received-voice controlling unit to control a tone and/or a volume of a received-voice signal in a mobile terminal according to an embodiment of the present general inventive concept.

Referring to FIG. 2, the received-voice controlling unit 113 includes a controlling unit 210 including a tone controlling unit 211 and a volume controlling unit 213, and a noise level determining unit 220.

The noise level determining unit 220 receives the input of the voice/noise flag and the microphone input signal, and determines a noise level to control a tone and/or a volume of a received-voice signal.

For example, when the voice flag is input, the noise level determining unit 220 calculates the noise level of a previously encoded packet (silent packet). The reason for calculating the noise level of the previously encoded packet is that when a speaker is currently speaking, the noise level calculated for the signal input through the microphone is unreliable. Accordingly, when the voice flag is input, a just-before calculated noise level, that is, the noise level of the previously encoded packet, is utilized to prevent unnecessary control of the volume and/or tone.

However, when the noise flag is input, the noise level determining unit 220 calculates the noise level of a current microphone input signal. In other words, when the noise flag is input, the noise level determining unit 220 determines that the signal input through the microphone is a current noise signal.

Also, the noise level determining unit 220 controls the controlling unit 210 by the determined noise level. In other words, the noise level determining unit 220 determines the amplification extent of the volume and/or tone of the received-voice signal by the calculated noise level.

The controlling unit 210 controls the volume and/or tone of the input received-voice signal by the amplification extent determined by the noise level determining unit 220. For this, the controlling unit 210 is provided with the tone controlling unit 211 and the volume controlling unit 213.

The tone controlling unit 211 controls the tone of the received-voice signal by the amplification information determined by the noise level determining unit 220. The tone may be controlled by amplifying a certain frequency band within a frequency included in the received-voice signal.

The volume controlling unit 213 controls the volume of the received-voice signal or the tone-controlled received-voice signal by the amplification information determined by the noise level determining unit 220. Herein, the volume may be controlled by amplifying an amplitude of the received-voice signal or the tone-controlled received-voice signal.

As described above, the tone controlling unit 211 and the volume controlling unit 213 control the tone and the volume of the received-voice signal, respectively, according to the result of the determination by the noise level determining unit 220, and then output the improved received-voice signal. In other words, as a result of the determination by the noise level determining unit 220, when the input signal input from the microphone (MIC) is voice, the tone and/or volume may be controlled by a previously used noise level, and when the input signal input from the microphone (MIC) is noise, the tone and/or volume may be controlled by using the noise level of a corresponding input signal. The control of the tone and the control of the volume may be sequentially performed, may be separately performed, or may be performed at once.

Figure 3:
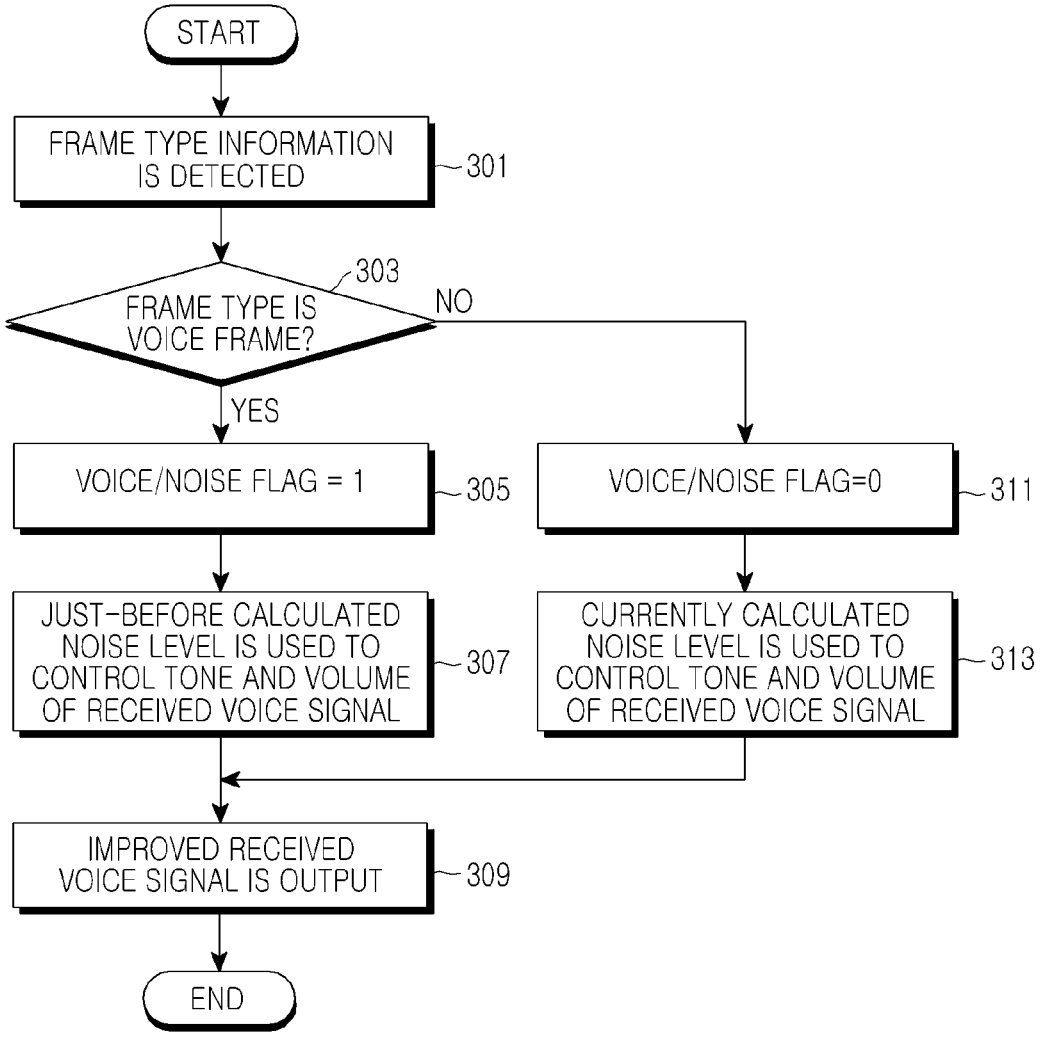
FIG. 3 is a flow diagram showing a method of processing a received-voice signal in a mobile terminal according to an embodiment of the present general inventive concept.

FIG. 3 is a flow diagram showing a method of processing a received-voice signal in a mobile terminal according to an embodiment of the present general inventive concept.

First, in operation 301, frame type information (packet characteristic information), which may be generated together with a packet during the voice encoding on the signal input from the microphone (MIC), is detected. In operation 303, a frame type is analyzed by using the detected frame type information and previously stored frame type information of the DSP 107. Herein, in this example, the previously stored frame type uses an AMR (Adaptive Multi-rate) frame type defined in 3G TS 26.093 "Source Controlled Rate Operation" as noted in Table 1.

TABLE 1

| TX_TYPE | Information Bits | Mode Indication | Meaning |
|---|---|---|---|
| SPEECH_GOOD | Speech frame, size 95 . . . 244 bits, depending on codec mode | Current codec mode | Voice frame |
| SPEECH_BAD | "Corrupt" speech frame (bad CRC), size 95 . . . 244 bits, depending on codec mode | Current codec mode | |
| SID_FIRST | Marker for the end of talkspurt, no further information, all 35 comfort noise bits "0" | The codec mode that would have been used if TX_TYPE had been "SPEECH_GOOD" | Silent frame |
| SID_UPDATE | 35 comfort noise bits | The codec mode that would have been used if TX_TYPE had been "SPEECH_GOOD" | |
| SID_BAD | Corrupt SID update frame (bad CRC) | The codec mode that would have been used if TX_TYPE had been "SPEECH_GOOD" | |
| NO_DATA | No useful information, nothing to be transmitted | No useful information | |

In other words, referring to Table 1, the frame type of the signal input from the microphone (MIC) is analyzed. As a result of the analysis of the frame type, when the frame type is "SPEECH_GOOD" or "SPEECH_BAD", the frame type of the signal is determined as a voice frame. Otherwise, when the frame type is any one of "SID_FIRST", "SID_UPDATE", "SID_BAD" or "NO_DATA", the frame type is determined as a silent frame. When the frame type is determined as a voice frame in operation 303, the process proceeds to operation 305 to set the voice/noise flag as "1". Since the frame type being a voice frame means that the signal input from the microphone is a voice signal, a noise level value currently calculated by the signal input from the microphone is unreliable. Accordingly, in operation 307, a noise level value calculated just prior to the currently calculated noise level value is used to control a received-voice signal, and then in operation 309, an improved received-voice signal is output through the speaker (SPK).

When the frame type is determined as a silent frame in operation 303, the process proceeds to operation 311 to set the voice/noise flag as "0". Since the frame type being a silent frame means that the signal input from the microphone (MIC) is a noise signal, a noise level value currently calculated for the signal input from the microphone (MIC) is reliable. Accordingly, in operation 313, the currently calculated noise level value is used to control the tone and volume of a received-voice signal, and then in operation 309, an improved received-voice signal is output through the speaker (SPK).

Figure 4:
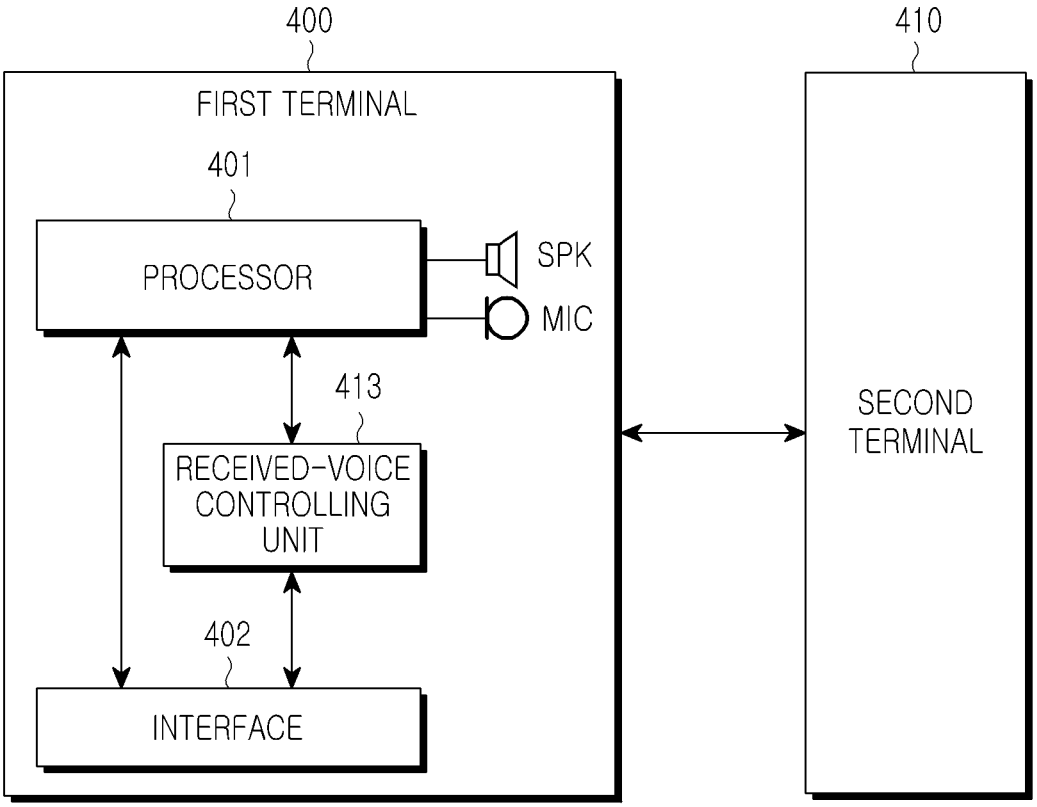
FIG. 4 is a view showing a configuration of a communication between mobile terminals according to an embodiment of the present general inventive concept.

FIG. 4 is a view showing a configuration of a communication between mobile terminals according to an embodiment of the present general inventive concept. As shown in FIG. 4, a first terminal 400 communicates with a second terminal 410 and includes a processor 401, an interface 402, and a received voice controlling unit 413. The processor 401 receives a voice signal input from a microphone (MIC) and outputs the processed voiced signal to a speaker (SPK). The processor 401 may include, but is not limited to including, various components such as a CPU, a DPRAM, a DSP, modulator/demodulator, and a PCM codec to process the voice signal input from the MIC.

The processor 401 receives the voice signal from the second terminal 410 and may perform voice encoding and voice decoding on the voice signal. The processor 401 may perform the control of a tone and/or a volume of the received-voice signal according to frame characteristic information generated through the voice encoding. The received-voice controlling unit 413 may receive the processed voice signal from the processor 401 to output an improved received-voice signal to the second terminal 410.

The first terminal 400 may also include an interface 402 to interface with the processor 401 and the received voice controlling unit 413. The interface 402 may be provided to communicate with the second terminal 410 to allow for other forms of communication such as, for example, text messaging and pictures received from the second terminal 410.

Figure 5:
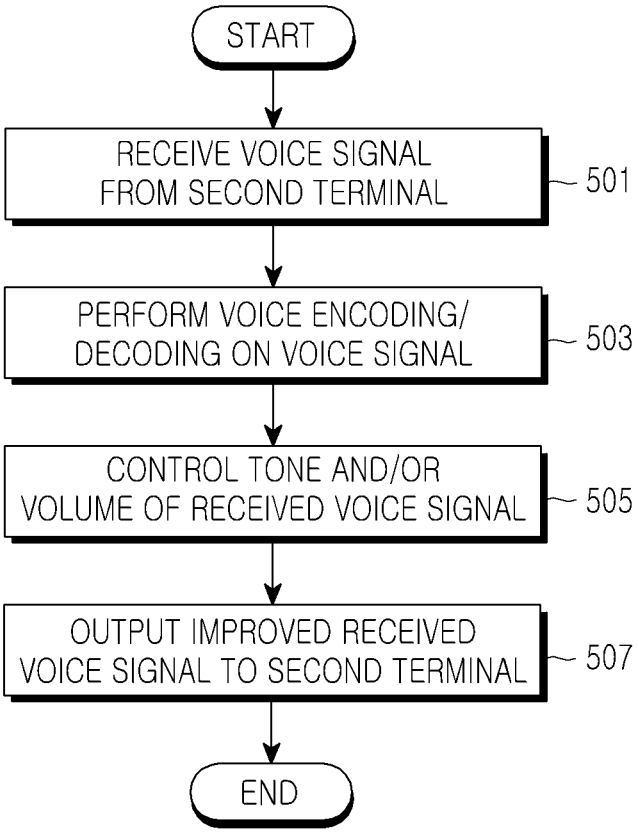
FIG. 5 is a flow diagram showing a method of receiving a received-voice signal from a mobile terminal according to an embodiment of the present general inventive concept.

FIG. 5 is a flow diagram showing a method of receiving a received-voice signal from a mobile terminal according to an embodiment of the present general inventive concept. As shown in FIG. 5, a first terminal 400 receives a voice signal from a second terminal 410 in operation 501. In operation 503, voice encoding and voice decoding is performed on the received voice signal. Control of a tone and/or volume of the received-voice signal according to frame characteristic information generated through the voice encoding is performed in operation 505. In operation 507, an improved received-voice signal is output to the second terminal 410 based on the frame characteristic information in operation 505.

According to the present general inventive concept using the above described method, it is possible to improve a listening ratio of received voice by determining if the signal input through a microphone includes voice without the performance of an additional operation, thereby reducing power consumption and time delay. Also, by using previously generated frame type information, computational complexity and the time delay may be reduced.

The present general inventive concept may also be embodied as computer-readable codes on a computer-readable medium. The computer-readable medium may include a computer-readable recording medium and a computer-readable transmission medium. The computer-readable recording medium is any data storage device that may store data that may be thereafter read by a computer system. Examples of the computer-readable recording medium include read-only memory (ROM), random-access memory (RAM), CD-ROMs, magnetic tapes, floppy disks, and optical data storage devices. The computer-readable recording medium may also be distributed over network coupled computer systems so that the computer-readable code is stored and executed in a distributed fashion. The computer-readable transmission medium may transmit carrier waves or signals (e.g., wired or wireless data transmission through the Internet). Also, functional programs, codes, and code segments to accomplish the present general inventive concept may be easily construed by programmers skilled in the art to which the present general inventive concept pertains.

While the present general inventive concept has been shown and described with reference to certain exemplary embodiments thereof, it will be understood by those skilled in the art that various changes in form and details may be made therein without departing from the spirit and scope of the general inventive concept as defined by the appended claims.

What is claimed is:

1. A method for processing a received-voice signal in a mobile terminal, the method comprising:

determining a frame type based on a signal input through a microphone included in the mobile terminal;

controlling the received-voice signal received from a counterpart terminal based on a previous noise level if the determined frame type corresponds to voice, and controlling the received-voice signal received from the counterpart terminal based on a noise level calculated by the input signal if the determined frame type corresponds to silence; and outputting the controlled received-voice signal through a speaker.

2. The method of claim 1, further comprising detecting whether the determined frame type belongs to a voice frame type or a silent frame type.

3. The method of claim 2, wherein the determined frame type is a frame type for Adaptive Multi-Rate (AMR) of the input signal.

4. The method of claim 3, wherein the controlling comprises:

controlling, if the determined frame type corresponds to the voice frame type, at least one of frequency amplification and volume amplification for the received signal based on the previous noise level; and calculating, if the determined frame type corresponds to the silent frame type, a noise level from the input signal, and controlling at least one of frequency amplification and volume amplification for the received signal based on the calculated noise level.

5. The method of claim 4, wherein the frame type for AMR is determined by encoding characteristics of the input signal.

6. The method of claim 5, wherein the voice frame type corresponds to a frame type in which the encoding characteristics are set as SPEECH_GOOD or SPEECH_BAD, and the silent frame type corresponds to a frame type in which the encoding characteristics are set as one of SID_FIRST, SID_UPDATE, SID_BAD, and NO_DATA.

7. The method of claim 4, wherein the frame type for AMR is defined for a Source Controlled Rate Operation.

8. A mobile terminal comprising:

a microphone;

a processor configured to determine a frame type based on a signal input through the microphone;

a controlling unit configured to control the received-voice signal received from a counterpart terminal based on a previous noise level if the determined frame type corresponds to voice, and to control the received-voice signal received from the counterpart terminal based on a noise level calculated by the input signal if the determined frame type corresponds to silence; and a speaker configured to output the controlled received-voice signal.

9. The mobile terminal of claim 8, wherein the processor detects whether the determined frame type belongs to a voice frame type or a silent frame type.

10. The mobile terminal of claim 9, wherein the determined frame type is a frame type for Adaptive Multi-Rate (AMR) of the input signal.

11. The mobile terminal of claim 10, wherein the controlling unit is configured to, control, if the determined frame type corresponds to the voice frame type, at least one of frequency amplification and volume amplification for the received-voice signal received from the counterpart terminal based on the previous noise level; and calculate, if the determined frame type corresponds to the silent frame type, a noise level from the input signal, and control at least one of frequency amplification and volume amplification for the received-voice received from the counterpart terminal signal based on the calculated noise level.

12. The mobile terminal of claim 11, wherein the processor determines the frame type for AMR by encoding characteristics of the input signal.

13. The mobile terminal of claim 12, wherein the voice frame type corresponds to a frame type in which the encoding characteristics are set as SPEECH_GOOD or SPEECH_BAD, and the silent frame type corresponds to a frame type in which the encoding characteristics are set as one of SID_FIRST, SID_UPDATE, SID_BAD, and NO_DATA.

14. The mobile terminal of claim 11, wherein the frame type for AMR is defined for a Source Controlled Rate Operation.

* * * * *